US011642761B1

(12) United States Patent
Morris

(10) Patent No.: US 11,642,761 B1
(45) Date of Patent: May 9, 2023

(54) TOOL WITH PIVOT, HANDLE, AND JAWS

(71) Applicant: Ricky Dean Morris, Bluff Dale, TX (US)

(72) Inventor: Ricky Dean Morris, Bluff Dale, TX (US)

( * ) Notice: Subject to any disclaimer, the term of this patent is extended or adjusted under 35 U.S.C. 154(b) by 308 days.

(21) Appl. No.: 16/903,997

(22) Filed: Jun. 17, 2020

(51) Int. Cl.
*B25B 7/04* (2006.01)
*B25B 7/10* (2006.01)

(52) U.S. Cl.
CPC . *B25B 7/04* (2013.01); *B25B 7/10* (2013.01)

(58) Field of Classification Search
CPC .... B25B 7/00; B25B 7/02; B25B 7/04; B25B 7/06; B25B 7/08; B25B 7/10; B25B 7/12; B25B 7/18; B25B 23/16; B25G 1/06
See application file for complete search history.

(56) References Cited

U.S. PATENT DOCUMENTS 6,336,387 B1 * 1/2002 Lee ..... B25B 7/00 81/416
6,370,992 B1 4/2002 Shi-Kuei
7,255,027 B1 * 8/2007 Tsai ..... B25B 7/10 81/357
7,267,606 B2 9/2007 Hsieh
7,735,399 B2 6/2010 Robinson et al.
8,276,486 B2 10/2012 Hseih
8,663,269 B2 * 3/2014 Randall ..... A61B 17/7083 606/207
2004/0089117 A1 * 5/2004 Hsien ..... B25B 7/00 81/424
2006/0230886 A1 10/2006 Hsien

OTHER PUBLICATIONS

TEKTON 5866 12-Inch Oil Filter Pliers—Automotive Oil Filter Pliers—Amazon.com listing dated Feb. 10, 2020 (4 pages).

* cited by examiner

*Primary Examiner* — Robert J Scruggs
(74) *Attorney, Agent, or Firm* — Fresh IP, PLC; Terrence L. B. Brown

(57) ABSTRACT

Tool including a pivot and a handle provided on one side of the pivot. The handle includes a first handle and a second handle. Jaws are provided on another side of the pivot, and the jaws include a first jaw and a second jaw. A first joint is provided in the first jaw. The first jaw includes a base provided between the first joint and the handle.

13 Claims, 2 Drawing Sheets

TOOL WITH PIVOT, HANDLE, AND JAWS

FIELD OF THE INVENTION

The invention relates to a tool. More particularly the invention relates to a tool with a first jaw and a second jaw.

SUMMARY OF THE INVENTION

There is a need for a versatile tool having a pivot, and a handle provided on one side of the pivot. The handle may include a first handle and a second handle. Jaws may be provided on another side of the pivot.

The invention may include a tool which may include a pivot, and a handle provided on one side of the pivot. The handle may include a first handle and a second handle. Jaws may be provided on another side of the pivot, the jaws including a first jaw and a second jaw. A first joint may be provided in the first jaw.

Further, the first jaw may include a base provided between the first joint and the first handle.

A second joint may be provided in the second jaw.

The second jaw may include a base provided between the second joint and the second handle.

Relative terms such as left, right, up, and down are for convenience only and are not intended to be limiting.

DETAILED DESCRIPTION OF THE INVENTION

Figure 1:
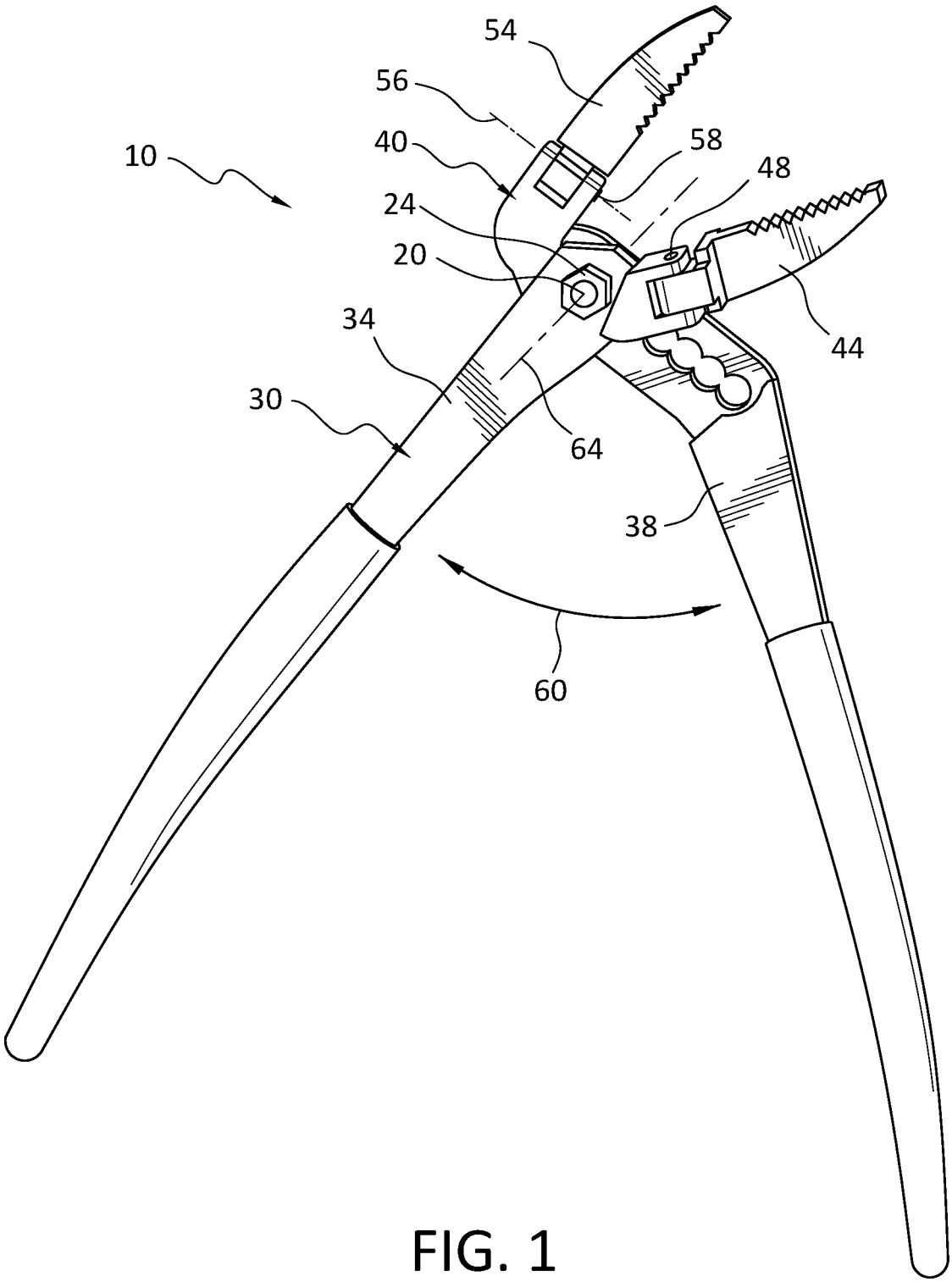
FIG. 1 is a plan view of a tool according to the invention.
Figure 2:
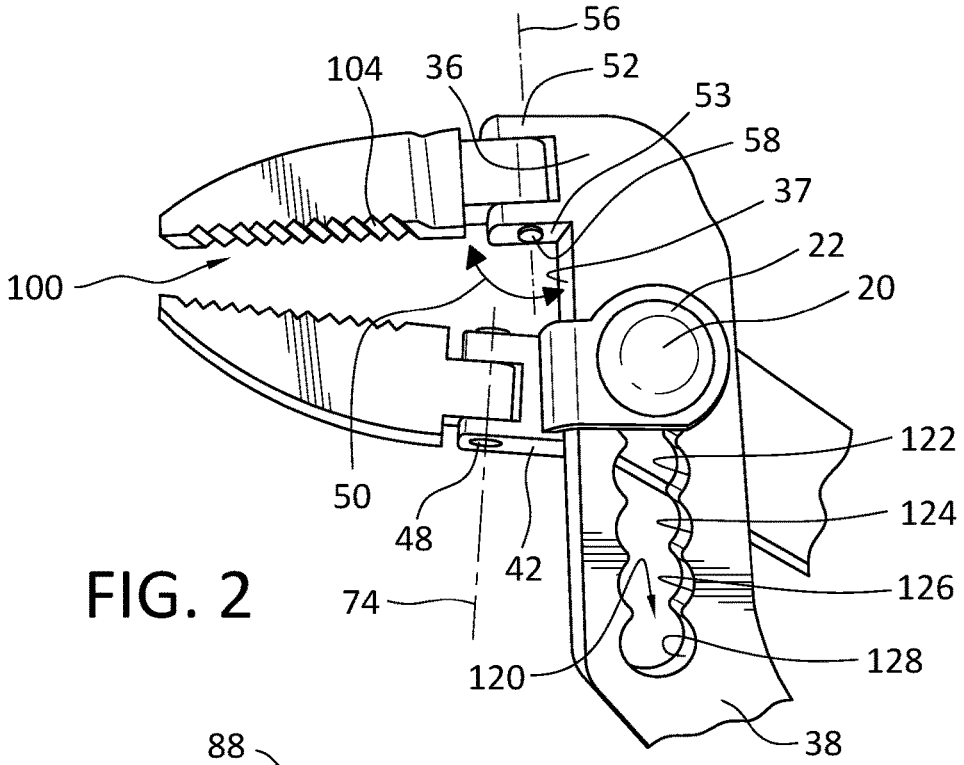
FIG. 2 is a perspective view of a portion of a tool according to the invention.
Figure 3:
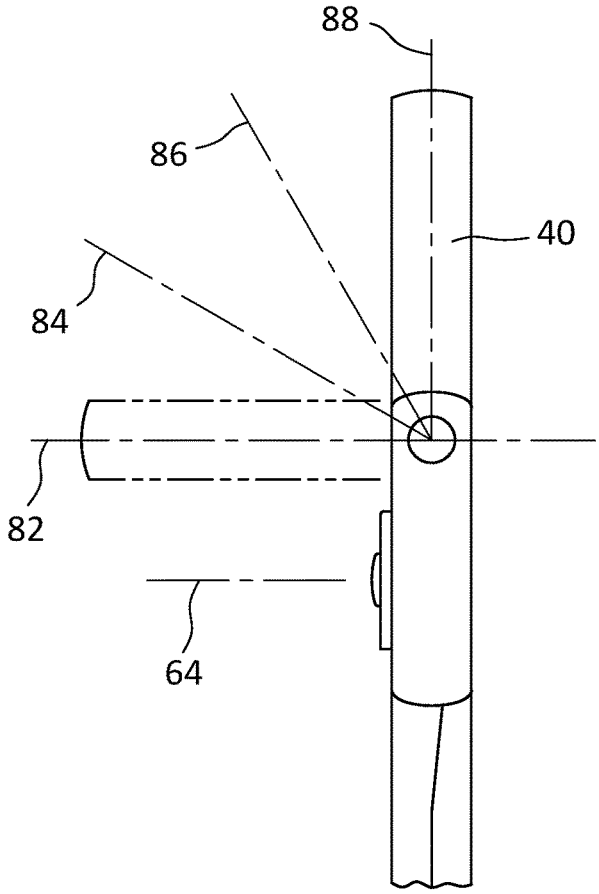
FIG. 3 is a side view of a portion of a tool according to the invention.

FIGS. 1-3 show a tool 10 according to the invention.

Tool 10 may include a pivot 20, and a handle 30 provided on one side of pivot 20. Pivot 20 may have a head 22 and a nut 24, as best seen in FIGS. 1-2. The handle 30 may include a first handle 34 and a second handle 38. Jaws 40 may be provided on another side of the pivot, the jaws 40 including a first or lower jaw 44 and a second or lower jaw 54, as viewed in FIG. 1. A first joint 48 may be provided in first jaw 44.

Further, first jaw 44 may include a first base 42 provided between the first joint 48 and the pivot 20. First base 42 may connect first jaw 44 to first handle 34. Second handle 38 may include an inner face 37 on an upper portion 36.

A second joint 58 may be provided in second jaw 54.

Second jaw 54 may include a second base 52 provided between second joint 58 and the pivot 20. Second joint 58 may have an axis of rotation 56. Second base 52 may connect second jaw 54 to second handle 38. Second base 52 may have a lower face 53 adjacent to inner face 37. An angle 50 may be defined between inner face 37 and lower face 53. Angle 50 may be a substantially right angle, as shown. Inner face 37 may face toward the jaws, and lower face 53 on upper portion 36 may be adjacent second jaw 54. The inner face 37 and the lower face 53 include the substantially right angle therebetween; and second jaw 54 extends at a substantially right angle to inner face 37 of upper portion 36 of second handle 38.

Pivot 20 provides rotation of first handle 34 and the second handle 38 in a direction 60 about a first axis of rotation 64 of pivot 20.

First joint 48 provides rotation of first jaw 44 around a first axis 74 through first joint 48. First axis of rotation 74 of joint 48 extends at an angle relative to first axis of rotation 64 of pivot 20 around which first handle 34 and second handle 38 rotate. Further, first axis of rotation 74 of joint 48 extends at an angle relative to second axis of rotation 56 of second joint 58. And in at least one position of first jaw 44 relative to second jaw 54 around axis 64 of pivot 20, first axis of rotation 74 is at an acute angle relative to second axis of rotation 56 of second jaw 54. As shown in FIG. 2, that acute angle defined by the at least one position of first jaw 44 relative to second jaw 54 opens facing away from inner face 37.

The first joint 48 and the second joint 58 may provide stepped rotation of the respective first and second jaws. The first joint 48 and the second joint 58 may likewise provide free rotation of the respective first and second jaws.

Teeth 100 may be provided on first jaw 44 and second jaw 54.

As shown second jaw 54 may include a tooth 104. Each jaw may include a plurality of teeth.

First joint 48 may provide rotation of first jaw 44 through at least an angle of about 90 degrees. First joint 48 may provide rotation of first jaw 44 through at least an angle of about 180 degrees.

Likewise, second joint 58 may provide rotation of second jaw 54 through at least an angle of about 90 degrees; and second joint 58 may provide rotation of second jaw 54 through at least an angle of about 180 degrees.

As best seen in FIG. 3, jaws 40 may be rotated about respective first joint 48 and second joint 58. Jaws 40 may be rotated to a number of stepped positions 82, 84, 86, and 88 at the same time. The stepped positions 82, 84, 86, and 88 may be at preselected 0(zero), 30, 60, and 90 degrees, such as by use of first joint 48 and second joint 58 having detents at those angles. First jaw 44 and second jaw 54 may be rotated independently of each other so that they are offset from one another.

Tool 10 may include a channel 120 including a series of notches 122, 124, 126, and 128 on second handle 38, as shown in FIG. 2. Channel 120 may be provided in second handle 38, such as in upper portion 36, as shown. The pivot 20 may be provided in channel 120, and pivot 20 may be movable along the channel, as will be readily understood by a person having ordinary skill in the art. Notches may be provided along the channel, as seen in FIGS. 1-2, each of the notches being sized for receiving pivot 20 and detachably securing pivot 20 within respective ones of the notches.

Figure 4:
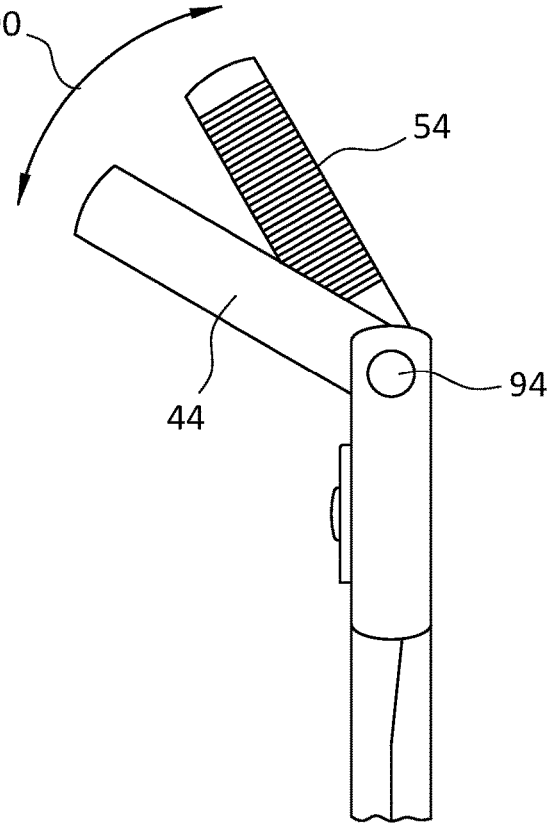
FIG. 4 is a side view of a portion of a tool according to the invention.

FIG. 4 shows an embodiment in which first jaw 44 and second jaw 54 may have freely selected positions along a path 90. A joint 94 may provide free rotation of first jaw 44 and second jaw 54 about joint 94.

Further, first jaw 44 may be rotated independently relative to the second jaw 54, as best seen in FIG. 4.

It is contemplated that the tool according to the invention be constructed as: elongated pliers, such as needle-nosed pliers; cutters having cutting blades; oil filter wrenches for installing and removing oil filters; wire strippers; and other tools.

It is further contemplated that the tool according to the invention be constructed as a hand tool or a machine-operated tool, or as a tool at the end of an electromechanical arm in environments where such are used.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A tool, the tool comprising:

a) a pivot;

b) a handle provided on one side of the pivot, the handle including a first handle and a second handle; the pivot provides rotation of the first handle and the second handle about an axis of rotation;

c) jaws provided on another side of the pivot, the jaws including a first jaw and a second jaw;

d) a first joint provided in the first jaw;

e) a channel provided in the second handle;

f) the pivot being provided in the channel and the pivot being movable along the channel;

g) notches provided along the channel, each of the notches sized for receiving the pivot and detachably securing the pivot within respective ones of the notches;

h) an upper portion provided on the second handle;

i) an inner face on the upper portion, the inner face facing toward the jaws, and a lower face on the upper portion adjacent the second jaw; and j) the inner face and the lower face including a substantially right angle therebetween;

k) the second jaw extending at a substantially right angle to the inner face of the upper portion;

l) A second joint is provided in the second jaw;

m) the first joint has a first axis of rotation;

n) the second joint has a second axis of rotation;

o) the second axis of rotation extends substantially parallel to the inner face;

p) in at least one position of the first jaw relative to the second jaw the first axis of rotation of the first joint is at an acute angle around the pivot relative to the second axis of rotation of the second joint; and q) the acute angle faces away from the inner face.

2. The tool as claimed in claim 1, wherein:

a) the first jaw includes a first base provided between the first joint and the pivot.

3. The tool as claimed in claim 1, wherein:

a) the second jaw includes a second base provided between the second joint and the pivot.

4. The tool as in claim 3, wherein:

a) the first jaw is rotated independently relative to the second jaw.

5. The tool as claimed in claim 1, wherein:

a) the first joint provides rotation of the first jaw about an axis of rotation extending at an angle relative to the axis of rotation of the pivot.

6. The tool as claimed in claim 1, wherein:

a) the first jaw includes a tooth.

7. The tool as in claim 6, wherein:

a) the tooth includes a plurality of teeth.

8. The tool as claimed in claim 6, wherein:

a) the second jaw includes a tooth.

9. The tool as in claim 8, wherein:

a) the tooth includes a plurality of teeth.

10. The tool as claimed in claim 1, wherein:

a) the first joint extends at an angle relative to the pivot.

11. The tool as in claim 1, wherein:

a) the first joint provides rotation of the first jaw through an angle of about 90 degrees.

12. The tool as in claim 1, wherein:

a) the first joint provides rotation of the first jaw through an angle of at least about 180 degrees.

13. The tool as in claim 1, wherein:

a) the first joint and the second joint provide stepped rotation of the respective first and second jaws.

* * * * *